US009427374B2

(12) United States Patent
Hoebel

(10) Patent No.: US 9,427,374 B2
(45) Date of Patent: Aug. 30, 2016

(54) THERAPEUTIC WALKING TRAINER

(71) Applicant: medica-Medizintechnik GmbH, Hochdorf (DE)

(72) Inventor: Otto Hoebel, Hochdorf (DE)

(73) Assignee: medica-Medizintechnik GmbH, Hochdorf (DE)

( * ) Notice: Subject to any disclaimer, the term of this patent is extended or adjusted under 35 U.S.C. 154(b) by 0 days.

(21) Appl. No.: 14/193,212

(22) Filed: Feb. 28, 2014

(65) Prior Publication Data

US 2014/0179493 A1 Jun. 26, 2014

Related U.S. Application Data

(63) Continuation of application No. PCT/DE2011/075206, filed on Aug. 31, 2011.

(51) Int. Cl.
*A61H 3/04* (2006.01)
*A61H 3/00* (2006.01)

(52) U.S. Cl.
CPC ..... *A61H 3/008* (2013.01); *A61H 3/04* (2013.01); *A61H 2003/043* (2013.01)

(58) Field of Classification Search
CPC ..... A61H 3/008; A61H 3/04; A61H 2003/08
USPC ..... 482/51, 66, 68, 69, 131, 132
See application file for complete search history.

(56) References Cited

U.S. PATENT DOCUMENTS 4,985,947 A * 1/1991 Ethridge ..... 5/86.1
5,569,129 A * 10/1996 Seif-Naraghi et al. ..... 482/69
6,343,802 B1 2/2002 Workman et al.
6,394,205 B1 * 5/2002 Akuzawa ..... 180/19.3
6,607,202 B1 * 8/2003 Palmer ..... 280/87.021
7,422,550 B1 * 9/2008 Pinero et al. ..... 482/68
2003/0181299 A1 9/2003 Matjacic et al.
2004/0002407 A1 * 1/2004 Hawkes et al. ..... 482/69
2004/0135326 A1 7/2004 Palmers et al.

(Continued)

FOREIGN PATENT DOCUMENTS

CN 1826093 A 8/2006
CN 201200781 Y 3/2009

(Continued)

OTHER PUBLICATIONS

Second Chinese Office Action dated Jun. 23, 2015 with English translation.

(Continued)

*Primary Examiner* — Sundhara Ganesan
(74) *Attorney, Agent, or Firm* — Muncy, Geissler, Olds & Lowe, P.C.

(57) ABSTRACT

A therapeutic walking trainer for improving the ability to walk, in particular for re-learning the ability to walk, with an upper frame, which has a torso-free body holder and provides forward support, and with a lower frame, which is connected to the upper frame by means of at least one supporting bar and has a number of rollers. To compensate for a torque acting on the vertical axis, the rollers are at least four in number, with at least one of the rollers, preferably exactly two of the rollers, being formed as drivable rollers. In addition, the invention relates to a combination of a therapeutic walking trainer with a motor-free treadmill, and the at least one supporting bar is connected to the lower frame via an elastic lower part.

24 Claims, 3 Drawing Sheets

(56) References Cited

U.S. PATENT DOCUMENTS

| | | | | |
|---|---|---|---|---|
| 2005/0101448 | A1 | 5/2005 | He et al. | |
| 2005/0288157 | A1* | 12/2005 | Santos-Munne et al. | 482/66 |
| 2007/0270723 | A1 | 11/2007 | Krebs et al. | |
| 2008/0231006 | A1* | 9/2008 | Van Eeden | 280/7.15 |

FOREIGN PATENT DOCUMENTS

| | | | | |
|---|---|---|---|---|
| CN | 201676135 | U | | 12/2010 |
| DE | 20 2008 008 347 | U1 | | 10/2008 |
| DE | 10 2009 024 478 | A1 | | 1/2011 |
| KR | 101278579 | B1 | * | 6/2013 |
| RU | 2 284 177 | C2 | | 9/2006 |
| SU | 700127 | A1 | | 11/1979 |
| WO | WO 2005/115298 | A1 | | 12/2005 |
| WO | WO 2008/145669 | A1 | | 12/2008 |

OTHER PUBLICATIONS

Third Chinese Office Action for Chinese Application No. 201180073116.2 dated Dec. 24, 2015 with English translation.

* cited by examiner

THERAPEUTIC WALKING TRAINER

This nonprovisional application is a continuation of International Application No. PCT/DE2011/075206, which was filed on Aug. 31, 2011, and which is herein incorporated by reference.

BACKGROUND OF THE INVENTION

1. Field of the Invention

The invention relates to a therapeutic gait trainer for improving the ability to walk, particularly for relearning to walk, with a top frame, having a torsion-limiting body holder and providing forward support, and a bottom frame, connected to the top frame by means of at least one supporting rod and having a number of rollers.

The invention relates in addition to a combination of a therapeutic gait trainer with a motor-free treadmill.

2. Description of the Background Art

A gait trainer of the aforementioned type is known from WO 2008/145669 A1. This trainer has an elaborate holding device whose advantage is that the device is designed torso-free. The pendular motion of the body performed when walking is not limited in the area of the torso. Said gait trainer also provides forward support, as a result of which falling in the walking direction is ruled out. A healthy person would compensate for such falling by simply stepping forwards with one of his two feet, which a person with a limited ability to walk cannot manage in most cases. It is disadvantageous, however, that it takes a very long time for the person to be treated to be secured in this gait trainer until the actual training session can be started. In addition, it is necessary in the case of the gait trainer that the person to be treated has already relearned some of his ability to walk in order to move at all with this gait trainer.

SUMMARY OF THE INVENTION

It is therefore an object of the invention to provide a therapeutic gait trainer of the aforementioned type, which is stable and easily accessible and which assures easy relearning or improvement of the ability to walk.

In addition, it is an object of the invention to provide a combination of a therapeutic gait trainer with a motor-free treadmill, which represents a space-saving training unit for a person to be treated.

The object related to the gait trainer is attained in an embodiment with a gait trainer of the aforementioned type in that to compensate for a torque acting on the vertical axis, the number of rollers is at least four, of which at least one, preferably precisely two of the rollers are formed as drivable rollers, and that the at least one supporting rod is connected to the bottom frame via an elastic bottom part.

This is associated with the advantage that a tipping over of the gait trainer is prevented, whereby the person to be treated is encouraged by the drivable rollers to follow the movement of the gait trainer, as a result of which an especially effective gait training is accomplished. The elastic bottom part thereby protects the person being trained from jolts because of an uneven floor. In addition, said elastic bottom part can be used to press the training person back into an upright position in the event of tipping over.

It has proven preferable within the scope of the invention if the drivable rollers can each be driven by means of a motor, preferably an electric motor, having a control, gear unit, and a rotary encoder. A different regulation of the drivable rollers assures that the gait trainer retains its stability also when driving around a curve, whereby the more outside roller in relation to the curve completes a more rapid movement than the more inside roller. Consequently, in the case of two driven rollers two controls are present, which regulate the particular roller speed. In so doing, it is useful if a so-called master operator panel is present, which is preferably formed as a terminal, which preferably synchronizes both controls by means of a serial transfer protocol.

It is also preferable if the drivable rollers can be controlled via a central control. As a result, an individual central control can regulate both drivable rollers in terms of their speed, whereby the central control must have a high clock rate and a large memory, in order to be able to process the feedback signals related to roller speed.

It is also useful if at least one shut-off device is provided that stops the drivable rollers upon encountering an obstacle. This assures that the gait trainer stops if it bumps against an obstacle, such as, for example, a wall.

It is especially preferable thereby, if the shut-off device is provided on a receptacle for the rollers and if it can be activated by the shifting of a float-mounted cap. This assures that during the shifting of the cap a switch of the shut-off device is actuated, which interrupts the power supply of the drivable rollers. The switch in this case can be constructed electrically or also mechanically using a design known to a person skilled in the art. A therapist can now also bring about a shut-off and thereby the stopping of the gait trainer by simply tilting against the cap. Of course, one of the shut-off devices can be provided on each receptacle for the rollers, whereby naturally it is also possible that a shut-off device is provided only on selected receptacles for the rollers.

A further possibility for realizing a stop function is disclosed in DE 11 2006 002 246 T5, which is incorporated herein by reference. It is possible in addition that the gait trainer has optical instruments, which allow it to detect a line on the floor and to be able to automatically follow it.

It is also useful, if a second roller pair formed by the drivable rollers is positioned between a non-driven first roller pair and a non-driven third roller pair on the bottom frame. It is thereby assured that when the drivable rollers start up, the gait trainer cannot tilt in the opposite direction of travel, because it is supported by the first roller pair or the third roller pair. Compensation for a torque acting on the vertical axis is also created thereby.

It has proven preferable here if the first roller pair and/or the third roller pair are steerable and if the second roller pair is mounted rigidly. As a result, the gait trainer is steerable overall, whereby the direction can be predetermined by the second rigidly mounted roller pair by propelling the left or right roller of the gait trainer with a different force.

It is an advantage, furthermore, if the bottom frame is made U-shaped with a bottom frame strut provided on the front end. This makes it easier for a person to be treated to access the gait trainer. In addition, the bottom frame strut may have a greater weight in order to lower overall the gait trainer's center of gravity.

It is practical in this regard if the bottom frame has a free space forming a walking area and provided preferably axially below the top frame. This creates the necessary freedom of movement for a person to be treated who is in the advanced stage of training. This person can now take larger steps without bumping into the bottom frame.

In order to increase the stability of the person to be treated, it is advantageous if the drivable rollers are provided in the vicinity of the ankles of a standing person to be treated.

In order to provide additional safety and support to the person to be treated, it is preferred that the top frame has at least one, preferably precisely two arm rests and/or a gripping component.

An embodiment of the therapeutic gait trainer is characterized in that at least one belt receptacle for a belt system attachable to a patient's hips is associated with the top frame. The belt system has a pelvic belt, which is attached in the area of the top frame with a pelvic belt coupling. The pelvic belt is made so that it encircles the pelvis and has leg loops for securing against vertical slipping. This results in a pelvic stabilization, which encircles the pelvic region of the person to be treated and allows the person to place himself in the holding device formed thereby, whereby said holding device does not pose an impediment for the person during walking. The pelvic stabilization prevents a possible fall by the person to be treated during the gait training. Preferably, the pelvic stabilization in the forward and backward direction can be attached to the person.

It is also of advantage if the top frame has at least one, preferably precisely two cross-struts, because the stability of the top frame is increased as a result.

It is advantageous in addition, if preferably precisely two supporting rods are provided, which are formed inclinable with two degrees of freedom. This increases the difficulty of the training with the therapeutic gait trainer, so that it also fulfills the requirements for a person to be treated who is in an advanced training stage. This type of supporting rods is known, for example, from EP 1 305 087 B1, to which reference is made at this point and which is to be expressly part of this disclosure.

In order to be able to use the therapeutic gait trainer for persons in any training stage, it is useful if on the top frame a balance lever is provided which releases or blocks the degrees of freedom of the supporting rods and preferably can realize an excursion of 0 degrees to 45 degrees in excursion steps or continuously.

To protect the training person, it has proven preferable that the bottom frame has a device for protecting a person's foot from being clamped; it keeps him from being bruised in the foot region particularly during a reversing of the gait trainer.

It is also advantageous, if the supporting rods each have at least one adjusting device for adjusting the gait trainer height. As a result, the gait trainer can be used by persons of different heights.

It is preferred, furthermore, if the opening, width of the bottom frame corresponds at least to the width of a wheelchair. As a result, it is made simpler for a wheelchair user, who would like to improve his ability to walk or to relearn how to walk, to get into the gait trainer. To this end, the supporting rods can be associated in each case with a supporting bar which protrudes perpendicular to these and on which the wheelchair user can pull himself into the gait trainer.

The object related to the combination is attained with a combination of a therapeutic gait trainer with a motor-free treadmill in that a connecting unit acting between the gait trainer and the treadmill is provided. As a result, the therapeutic gait trainer during training of a person to be treated need not move from one place to another place in order to achieve the desired training effect.

In this regard, it has proven useful if a ramp for driving up the gait trainer is provided. In the case of the combination a gait trainer as explained in the preceding sections can be used.

In order not to have to propel the treadmill solely by the steps of the person to be treated, it has proven especially preferable, if the treadmill can be driven by means of the gait trainer's drivable rollers movable by a motor.

A preferred embodiment of the combination is characterized in that the connecting unit is formed from a receiving mouth, having a safety bolt acted upon by a spring, and from a coupling part, having a bolt receiver open on one side and insertable in said mouth, a locking member is formed on the safety bolt circumferentially and a lock receiver, corresponding to the locking member, on the bolt receiver, and the coupling part is preferably associated with the gait trainer and the receiving mouth with the treadmill. As a result, a secure connection that is simple to connect or release is created between the treadmill and the gait trainer.

The invention will be described in greater detail below with exemplary embodiments shown in the drawings; shown are:

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
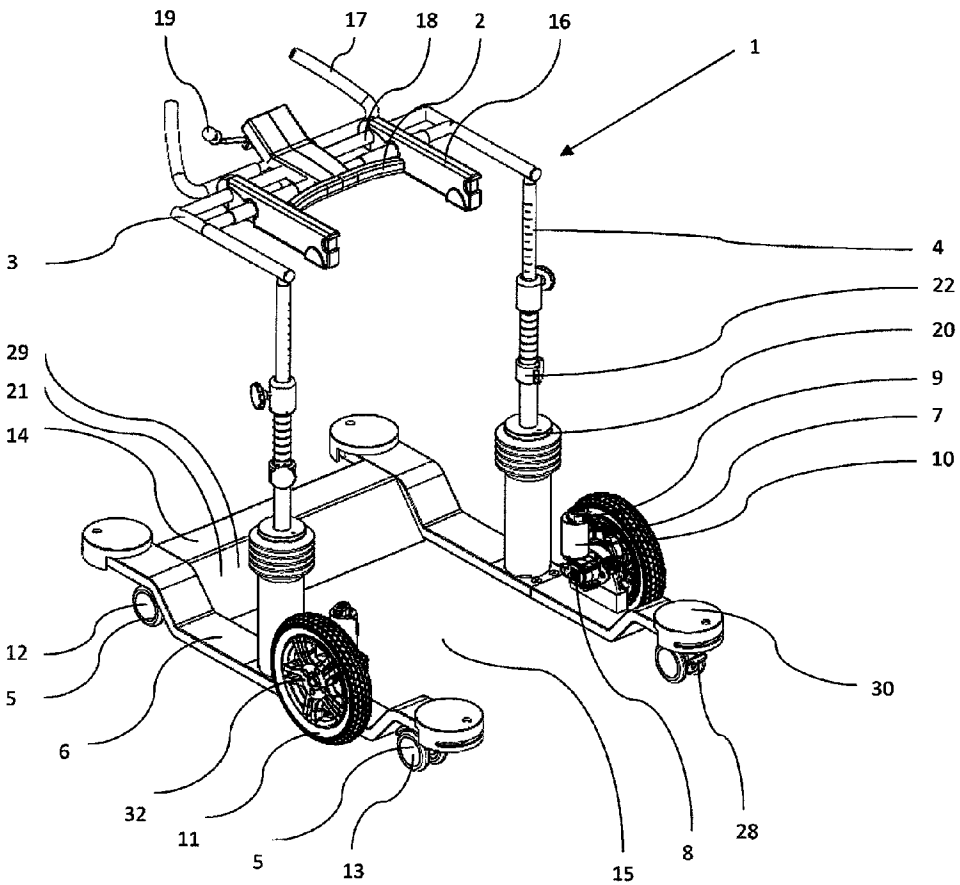
FIG. 1 is a perspective view of the gait trainer of the invention.

FIG. 1 shows a therapeutic gait trainer 1 for improving the ability to walk, particularly for relearning to walk, with a top frame 3, having a torsion-limiting, particularly a torso-free body holder 2 and providing forward support, and a bottom frame 6, connected to the top frame by means of supporting rods 4 and having a number of rollers 5. To compensate for a torque acting on the vertical axis, the number of rollers 5 is six in the shown exemplary embodiment, of which precisely two of rollers 5 are formed as drivable rollers 32. Supporting rods 4 are connected to bottom frame 6 via an elastic bottom part 20.

Drivable rollers 32 are each drivable by means of an electric motor having a control 7, gear unit 8, and a rotary encoder 9. Rotary encoder 9 in the exemplary embodiment is formed as a magnetic rotary encoder 9, whereby the use of other rotary encoders 9 such as, for example, an optical incremental pulse encoder or a directional encoder is also possible. Likewise, a speed determination can also occur via a measurement of the actual motor voltage of the electric motor. In control 7 a 4-quadrant or H-circuit is provided for the direction setting of motors 10. A braked forward mode, an accelerated forward mode, a braked reverse mode, and an accelerated reverse mode can be realized by this H-circuit for each of the two drivable rollers, whereby the current is proportional to the torque of the electric motor. Upon starting or stopping of therapeutic gait trainer 1, it is useful if motor 10 does not immediately begin at full speed or reduces the speed to zero. In order to avoid such jerky starting and stopping, motor 10 uses so-called speed ramps measured by rotary encoder 9 and gently accelerating gait trainer 1.

In the shown exemplary embodiment, a second roller pair 11 formed by drivable rollers 32 is positioned between a non-driven first roller pair 12 and a non-driven third roller pair 13 on bottom frame 6. In this regard, first roller pair 12 and third roller pair 13 are mounted steerable and second roller pair 11 rigidly. First roller pair 12 and third roller pair 13 in this case have in a manner known per se a strap 28 for their locking. In addition, a receptacle 30 for rollers 5 can be seen, where a shut-off device is provided which stops drivable rollers 32 if an obstacle is encountered and which can be activated by the shifting of a float-mounted cap 33. In the shown exemplary embodiment, cap 33 can slide horizontally and upon sliding actuates a switch, as a result of which gait trainer 1 is stopped.

Bottom frame 6 of therapeutic gait trainer 1 is formed U-shaped with a bottom frame strut 14 provided on the front end. Bottom frame 6 has a free space 15, which is formed as a walking area and is provided axially below top frame 3. In addition, a device 21 is provided on bottom frame 6 for protecting a person's foot from being clamped, which is formed here as a safety bar 29. Overall, bottom frame 6 is positioned very close to the floor, so that clamping of a person's foot is made difficult and a low-lying center of gravity of gait trainer 1 is attained. It is also possible here, however, that bottom frame 6 is arranged in a position far removed from the floor, as a result of which clamping of the patient's foot is also ruled out. The opening width of bottom frame 6 is greater than the width of a standard wheelchair and supporting rods 4 each have an adjusting device 22 for adjusting the gait trainer height.

Precisely two arm rests 16 and a gripping component 17 are arranged on top frame 3, whereby top frame 3 has precisely two cross-struts 18. Said gait trainer 1, of course, can also manage with only one cross-strut 18. Likewise, arm rests 16 can be made in the form of a support table. The two arm rests 16 can be moved along the two cross-struts 18, so that persons of a different width can use therapeutic gait trainer 1. The arm rests 16 shown here can be placed close to the body of a patient to be treated and also serve as lateral boundaries for the patient's hips, as a result of which the patient is efficiently supported. Further, a belt receptacle for a belt system attachable to a patient's hips is associated with top frame 3, whereby in the exemplary embodiment shown in the drawing (FIG. 3) the belt system consists of a pelvic belt 34. Pelvic belt 34 is attached in the area of top frame 3 with a pelvic belt coupling 35. The pelvic belt is made so that it encircles the pelvis and has leg loops 36 for securing against vertical slipping.

In the shown exemplary embodiment, two supporting rods 4 having two degrees of freedom are made inclinable. To this end, on top frame 3 a balance lever 19 is provided which releases or blocks the degrees of freedom of supporting rods 4.

Figure 2:
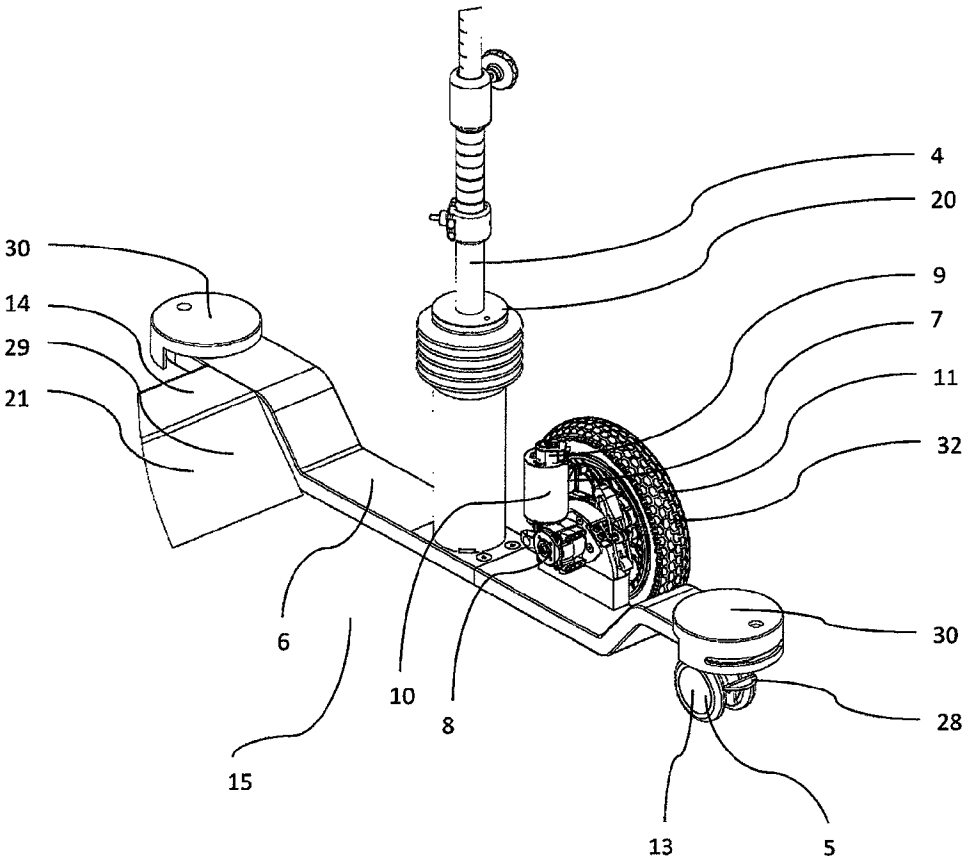
FIG. 2 is a detailed view of a part of the bottom frame.

Cylindrical motor 10 with control 7, rotary encoder 9, and gear unit 8, which is positioned next to supporting rod 4, is clearly evident in FIG. 2, in the detail of bottom frame 6 of the embodiment of FIG. 1. It can be seen that drivable rollers 32 are made larger than the steerable non-driven rollers 5, whereby the size of drivable rollers 32 is proportional to the speed of gait trainer 1. It is shown further that drivable rollers 32 are provided in the vicinity of the ankles in the case of a standing person to be treated.

Finally, means 21 formed as safety bar 29 for protecting a person's foot from being clamped is also shown again, whereby further bottom frame 6 is lowered close to the floor overall relative to receptacle 30 for non-driven rollers 5.

Figure 3:
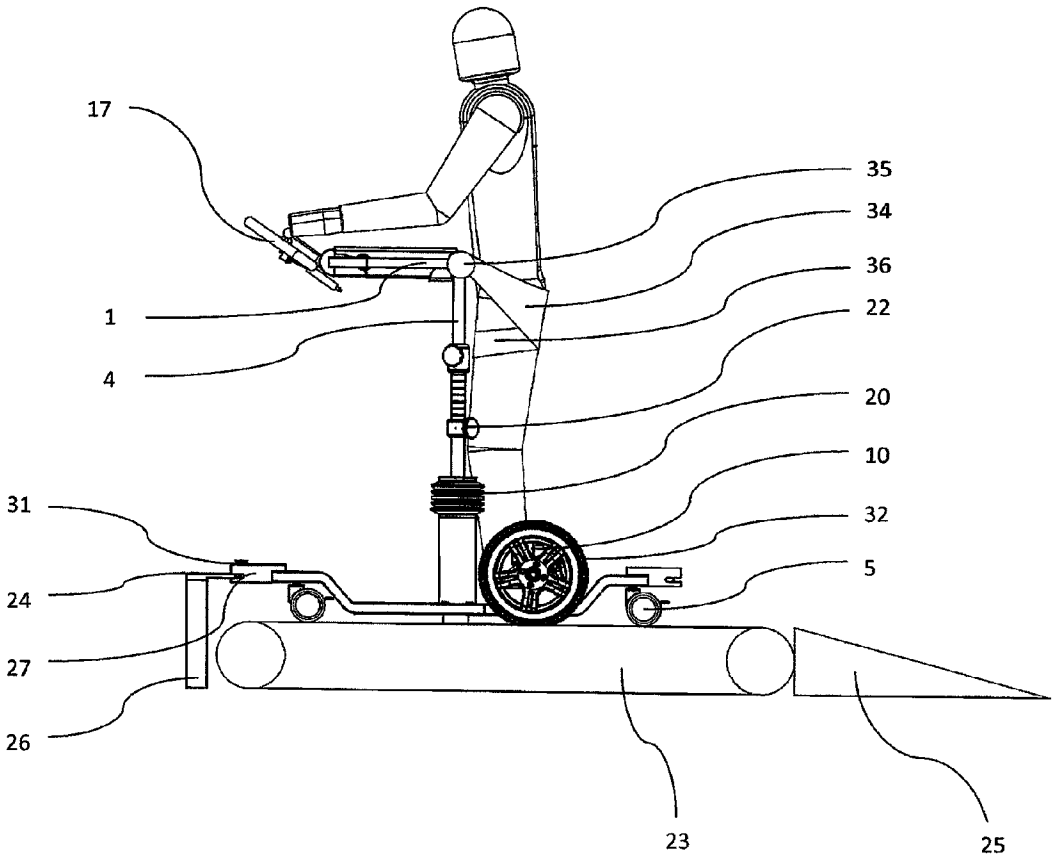
FIG. 3 is a side view of a combination of the invention.

A combination of a therapeutic gait trainer 1 with a motor-free treadmill 23 is shown in FIG. 3. A connecting unit 24 is provided between gait trainer 1 and treadmill 23. Further, a ramp 25 for driving up gait trainer 1 is provided.

In the shown exemplary embodiment, treadmill 23 can be driven by drivable rollers 32, movable by a motor 10, of gait trainer 1 and connecting unit 24 is formed from a receiving mouth 26, having a safety bolt acted upon by a spring, and from a coupling part 27, having a bolt receiver open on one side and insertable in said mouth. A locking member is formed on the safety bolt and a lock receiver, corresponding to the locking member, on the bolt receiver. Coupling part 27 is associated with gait trainer 1 and receiving mouth 26 with treadmill 23, whereby the safety bolt has a handle 31 in order to release the form-fitting connection between the locking member and the lock receiver against the pressure of the spring.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A therapeutic gait trainer for a patient for improving the ability to walk, comprising:

a top frame having two first top frame sections that each include first and second ends;

a second top frame section connecting the first ends of the first top frame sections;

a first extended section and a second extended section disposed between the first top frame sections and extending in a direction towards the patient;

a torsion-limiting body holder extending from the first extended section to the second extended section and providing support for the patient, the first top frame sections extending in a driving direction of the therapeutic gait trainer, the second top frame section being arranged to be disposed in a direction of a patient in use;

a bottom frame having two first bottom frame sections and a second bottom frame section connecting the two first bottom frame sections, the first bottom frame sections being parallel with the first top frame sections, the second bottom frame section being arranged to be disposed in front of the patient in use;

two supporting rods respectively connecting the first top frame sections of the top frame and center sections of the first bottom frame sections of the bottom frame; and a plurality of rollers provided on the first bottom frame sections of the bottom frame, wherein, to compensate for a torque acting on the vertical axis, the plurality of rollers is at least four, of which at least one or two of the rollers are made as drivable rollers, wherein an elastic bottom part is provided between each of the two supporting and the bottom frame so as to connect each of the two supporting rods to the bottom frame, and wherein a belt system attachable to the hips of the patient is provided, which is connected to at least one belt receptacle associated with the top frame.

2. The therapeutic gait trainer according to claim 1, wherein the belt system is formed from a pelvic belt attachable via a pelvic belt coupling to the top frame for encircling the pelvis with leg loops for protection against vertical slipping.

3. The therapeutic gait trainer according to claim 1, wherein the drivable rollers are each drivable by a motor or an electric motor having a control, a gear unit, and a rotary encoder.

4. The therapeutic gait trainer according to claim 1, wherein the drivable rollers can be controlled via a central control.

5. The therapeutic gait trainer according to claim 1, wherein at least one shut-off device is provided that stops the drivable rollers upon encountering an obstacle.

6. The therapeutic gait trainer according to claim 5, wherein the shut-off device is provided on a receptacle for the rollers and is activatable by the shifting of a float-mounted cap.

7. The therapeutic gait trainer according to claim 1, wherein a second roller pair formed by the drivable rollers is positioned between a non-driven first roller pair and a non-driven third roller pair on the bottom frame.

8. The therapeutic gait trainer according to claim 7, wherein the first roller pair and/or the third roller pair are steerable, and that the second roller pair is mounted rigidly.

9. The therapeutic gait trainer according to claim 1, wherein the bottom frame is made U-shaped with a bottom frame strut provided on the front end.

10. The therapeutic gait trainer according to claim 9, wherein the bottom frame has a free space forming a walking area and which is provided axially below the top frame.

11. The therapeutic gait trainer according to claim 1, wherein the drivable rollers are provided in the vicinity of the ankles of a standing person to be treated.

12. The therapeutic gait trainer according to claim 1, wherein the top frame has a gripping component extending from the second top frame section of the top frame in a direction away from the patient.

13. The therapeutic gait trainer according to claim 1, wherein the second top frame section of the top frame is configured from at least one or two cross-struts and straight side bards that are perpendicularly connected to the cross-struts.

14. The therapeutic gait trainer according to claim 1, wherein the two supporting rods are formed inclinable with two degrees of freedom.

15. The therapeutic gait trainer according to claim 14, wherein on the top frame a balance lever is provided which releases or blocks the degrees of freedom of the supporting rods and realizes an excursion from 0 degrees to 45 degrees in excursion steps or continuously.

16. The therapeutic gait trainer according to claim 1, wherein the second bottom frame section of the bottom frame has a device for protecting a person's foot from being clamped.

17. The therapeutic gait trainer according to claim 1, wherein the supporting rods each have at least one adjusting device for adjusting the gait trainer height.

18. The therapeutic gait trainer according to claim 1, wherein an opening width of the bottom frame corresponds at least to a width of a wheelchair.

19. A combination of the therapeutic gait trainer according to claim 1 with a motor-free treadmill, wherein a connecting unit acting between the gait trainer and the treadmill is provided, and wherein the treadmill is drivable by drivable rollers and movable via a motor of the gait trainer.

20. The combination according to claim 19, wherein a ramp for driving up the gait trainer is provided.

21. The combination according to claim 19, wherein the connecting unit is formed from a receiving mouth having a safety bolt acted upon by a spring, and from a coupling part having a bolt receiver open on one side and insertable in said mouth, a locking member is formed on the safety bolt circumferentially and a lock receiver, corresponding to the locking member, on the bolt receiver, and the coupling part being associated with the gait trainer and the receiving mouth with the treadmill.

22. The therapeutic gait trainer according to claim 6, wherein during the shifting of the float-mounted cap, a switch of the shut-off valve is actuated, causing power supply to the drivable rollers to be interrupted.

23. The therapeutic gait trainer according to claim 1, wherein the first and second extended sections are first and second arm rests.

24. The therapeutic gait trainer according to claim 1, wherein the first and second extended sections extend from the second top frame section.

* * * * *